US010697100B2

(12) United States Patent
Visentin

(10) Patent No.: US 10,697,100 B2
(45) Date of Patent: Jun. 30, 2020

(54) TEXTILE MANUFACTURED ARTICLE REALIZED BY EMBROIDERY MACHINES

(71) Applicant: RICAMIFICIO GEA SNC, Bolladello di Cairate (Varese) (IT)

(72) Inventor: Fabio Visentin, Cairate (IT)

(73) Assignee: RICAMIFICIO GEA SNC, Bolladello di Cairate (IT)

( * ) Notice: Subject to any disclaimer, the term of this patent is extended or adjusted under 35 U.S.C. 154(b) by 182 days.

(21) Appl. No.: 16/073,153

(22) PCT Filed: Jan. 29, 2016

(86) PCT No.: PCT/IT2016/000023
§ 371 (c)(1),
(2) Date: Jul. 26, 2018

(87) PCT Pub. No.: WO2017/130227
PCT Pub. Date: Aug. 3, 2017

(65) Prior Publication Data

US 2019/0010645 A1 Jan. 10, 2019

(51) Int. Cl.
*D06C 17/00* (2006.01)
*D05C 17/00* (2006.01)

(52) U.S. Cl.
CPC ..... *D05C 17/00* (2013.01); *D10B 2201/02* (2013.01); *D10B 2201/04* (2013.01); *D10B 2201/24* (2013.01); *D10B 2211/04* (2013.01); *D10B 2331/02* (2013.01); *D10B 2331/04* (2013.01)

(58) Field of Classification Search
CPC .... D05C 17/00; D05C 17/023; D05C 17/026; D10B 2201/02; D10B 2201/04; D10B 2201/24; D10B 2211/04; D10B 2331/02; D10B 2331/04; A42D 13/00; A42D 31/00; A42D 31/0005; A42D 31/02
See application file for complete search history.

(56) References Cited

U.S. PATENT DOCUMENTS

| | | | | | |
|---|---|---|---|---|---|
| 2,901,005 | A * | 8/1959 | Schwartz | D05C 17/023 | 139/420 B |
| 3,377,678 | A | 4/1968 | Moriya | | |
| 3,766,872 | A * | 10/1973 | Krieger | D04C 1/04 | 112/439 |
| 4,621,012 | A * | 11/1986 | Pusch | B32B 15/08 | 442/228 |
| 5,001,782 | A * | 3/1991 | Stewart | A41D 27/08 | 2/244 |
| 5,111,760 | A * | 5/1992 | Garzone, Jr. | D06Q 1/005 | 112/439 |
| 5,281,460 | A * | 1/1994 | Cox | F41H 3/02 | 2/69 |
| 5,715,767 | A | 2/1998 | Cohen et al. | | |
| 6,092,562 | A * | 7/2000 | Debaes | D03D 27/10 | 139/398 |
| 6,851,126 | B1 * | 2/2005 | Humphreys | A41D 13/00 | 2/243.1 |
| 8,112,819 | B2 * | 2/2012 | Larson | F41H 3/02 | 2/94 |
| 10,221,513 | B2 * | 3/2019 | Visentin | D05C 7/08 | |
| 2005/0153614 | A1 * | 7/2005 | Dohler | D05C 1/08 | 442/181 |
| 2015/0211162 | A1 | 7/2015 | Visentin | | |

FOREIGN PATENT DOCUMENTS

| | | | |
|---|---|---|---|
| CN | 1080236 | A | 1/1994 |
| GB | 191204749 | A | 8/1912 |
| WO | 2014024054 | A1 | 2/2014 |

* cited by examiner

*Primary Examiner* — Ismael Izaguirre
(74) *Attorney, Agent, or Firm* — Pearne & Gordon LLP

(57) ABSTRACT

Textile manufactured article made with embroidering machines, comprising a base structure and at least one thread-like and/or ribbon-like element. The base structure is composed of thread-like and/or ribbon-like elements made of at least a first material. The ornamental thread-like and/or ribbon-like element is made of at least a second material, different from the first material in terms of mechanical resistance and light reflection/refraction. The ornamental thread-like and/or ribbon-like element is connected to the base structure through a plurality of knottings, arranged at pre-defined intervals along the thread-like and/or ribbon-like element realized made of at least the first material. The first material is a nylon having a yarn number between 40,000 Nn and 80,000 Nm.

34 Claims, No Drawings

TEXTILE MANUFACTURED ARTICLE REALIZED BY EMBROIDERY MACHINES

The present invention relates to an improved textile manufactured article made with specific embroidery machinery.

As it is known, making textile manufactured articles according to specific technologies of current embroidery machines involves the possibility of defining particular mesh patterns, which most often are made with textile fibres, generally of the same type of warp and weft.

While being extensively employed, the above-outlined known technique has some drawbacks, both in terms of the intrinsic fragility of the manufactured articles made with embroidery machines and for the aesthetic-visual limitations of the embroidered manufactured articles from the user's point of view (but also, and especially, for the clothing industry operator, who must "assemble" those embroidered manufactured articles into a complete clothing item or in a complex clothing accessory).

For example, known-type meshing patterns of manufactured articles made with embroidery machines may be too delicate or otherwise not able to withstand stresses (e.g., tensile or "creasing" stress) of significant entity, or otherwise cannot be made especially resistant if one wishes to obtain a rather broad mesh structure (which is just one of the visual features for which embroidered manufactured articles are made).

Similarly, the use of known-type fibres does not allow to confer particular optical properties to the manufactured article, such as e.g. a certain gloss or non-negligible ability of "treating" incident light in terms of refraction and/or reflection (e.g. for conferring greater gloss to the manufactured article or even a metallic or otherwise shiny appearance).

Patent application PCT/IB2013/054141 describes a manufactured article made with embroidery machines which is able to overcome the above limitations, providing a manufactured article possessing a superior mechanical strength and an aesthetic-visual appearance hardly reproducible with traditional embroidery machines, also having the purpose of conceiving a manufactured article made with embroidery machines which can have distinctive optical properties in terms of light reflection and/or refraction, so as to give an innovative aspect compared to manufactured articles made with standard embroidery machines.

Often, in order to contain production costs or in order to make particularly precise needlework, the current trend of embroidery works towards the use of thinner and thinner thread-like and/or ribbon-like elements.

However, the spooling step of thread-like or ribbon-like elements with which the manufactured article must be made requires that the thread-like or ribbon-like elements possess a certain mechanical resistance, so that these do not break during the winding on the spool itself.

In this context, the underlying technical task of the present invention is to propose an improved textile manufactured article, which can be made with specific embroidery machines, being quickly configurable in different weaving variants and by simple operations on the same machines, in order to improve productivity.

A further object of the present invention is to provide an improved textile article ensuring excellent resistance features, also for very low thread thickness.

The mentioned technical task and the specified objects are substantially achieved by an improved textile manufactured article made with embroidery machines, comprising the technical features set out in one or more of the appended claims.

In particular, the present invention provides a textile manufactured article made with improved embroidery machines, comprising a base structure and at least one thread-like and/or ribbon-like element.

The base structure is composed of thread-like and/or ribbon-like elements made at least of a first material.

The ornamental thread-like and/or ribbon-like element is made of at least a second material, different from the first material in terms of mechanical resistance and light reflection/refraction.

The ornamental thread-like and/or ribbon-like element is connected to the base structure through a plurality of knottings, arranged at pre-defined intervals along the thread-like and/or ribbon-like elements made at least of the first material.

Advantageously, the first material is a nylon having a yarn number between 40,000 Nn and 80,000 Nm.

The Applicant has found that, by adding a nylon with the above-mentioned yarn number, it is possible to obtain an improved textile manufactured article with excellent mechanical resistance features and to enhance the efficiency and process productivity of the embroidery process.

The dependent claims, included here for reference, correspond to different embodiments of the invention.

Below is set forth the description of a preferred but not exclusive embodiment of a manufactured article according to the invention, by way of example and not of limitation.

The manufactured article according to the present invention is specifically made with embroidery machines and includes a base structure composed of thread-like elements (and/or also ribbon-like, according to the needs of the moment) made at least of a first material having appropriate mechanical and optical properties.

Advantageously, and unlike known-type textile manufactured articles obtained from embroidery machines, this further comprises at least one ornamental thread-like (and/or ribbon-like, always depending on the needs of the moment) element: this element is made of at least a second material, different from the first material mentioned just above in terms of mechanical strength and light reflection/refraction.

Due to the difference in optical and mechanical features, the base structure of this manufactured article may then perform a strengthening function of the manufactured article, while performing at the same time an "optical treatment" function by affecting incident, reflected and/or refracted light on the manufactured article.

Complementarily to the functions performed by the base structure, the thread-like and/or ribbon-like element is connected to the latter by a plurality of knottings arranged at pre-defined intervals along the thread-like or ribbon-like elements made of the "first material": by suitably choosing the type of knotting and relative distances between knottings a unique aesthetic effect is obtained, as well as a substantial shape and connection stability between the ornamental element and the base structure.

Breaking down the invention into its embodiment detail, it should be noted that, depending on the needs of the moment, the base structure may be arranged into weft threads and warp threads, mutually interlinked or, more generally, if the purpose is to obtain particular effects or fabrics, the base structure can define an ornamental embroidered pattern: such ornamental pattern is conveniently made with an embroidery machine, preferably adapted to perform a macramé-type processing.

From the viewpoint of material choice and, as a consequence, of differentiation of optical and mechanical properties of the base structure relative to the ornamental thread and/or ribbon, the present improved textile manufactured article advantageously involves the fact that the "first material" is a nylon having a yarn number between 40,000 Nn and 80,000 Nm.

The Applicant has found that the nylon with this yarn number is sufficiently strong and particularly effective to allow a rapid and effective spooling, limiting as much as possible the thickness of the first material, and thereby raw material costs.

At this point, it must be noted that the choice of the nylon with yarn number between 40,000 Nm and 80,000 Nm in textile manufactured articles made with embroidery machines is not a randomly chosen, but is the result of a series of tests the Applicant performed in order to find the best technical compromise in terms of strength, cost and thickness, thus constituting an innovative element compared to the previously mentioned state of the art, hence termed "improved".

Thanks to the present invention, it is possible to achieve great mechanical strength joined to an equally original light reflection and refraction mode, which in turn confers an absolutely unique aesthetic-visual appearance to the present invention.

Instead, with respect to the possible embodiment choices regarding the "second material", the present invention may include the use of different types of material.

Preferably, the second material comprises a cotton, e.g., a cotton thread made with two mutually plied threads and defining an overall diameter comprised between 20 μm and 80 μm, preferably equal to 60 μm.

Preferably, the second material comprises a silk, e.g. a silk made with two mutually plied threads and even more preferably having a yarn number of 2/120,000 Nm.

Preferably, the second material comprises a lamé and/or a lurex, e.g. a lamé and/or lurex twisted with at least a polyamide thread with a weight percentage of polyamide between 10% and 28% and of viscose between 90% and 72%.

Preferably, the second material comprises a polyester.

Preferably, the second material comprises a cashmere, e.g. a single-thread cashmere, and still more preferably having a yarn number of 280 deniers.

Preferably, the second material comprises a viscose, even more preferably having a yarn number greater than or equal to 80,000 Nm.

Preferably, the second material comprises a linen, even more preferably having a yarn number with value comprised between 15,000 Nm and 16,000 Nm.

Preferably, the second material comprises a linen, having an amount by weight preferably of 90%, and a silk, having an amount by weight preferably of 10%.

Even more preferably, this linen-silk composition has a yarn number of 39,000 Nm.

Preferably, the second material comprises a linen, having an amount by weight preferably of 70%, and a Tencel®, having an amount by weight preferably equal to 30%.

Even more preferably, this linen-Tencel® composition has a yarn number of 26,000 Nm.

The Tencel® (or Lyocell) fibres are a separate category of fibres whose starting material itself is the cellulose extracted from wood. The Tencel® fibres have high dry and wet strength, are smooth and absorb moisture very well. Advantageously, therefore, textile products made of Tencel® are smooth and fresh to the touch and have a low propensity for creasing.

Preferably, the second material comprises a hemp, e.g. a single-thread hemp, and still more preferably having a yarn number of 36,000 Nm.

Preferably, the second material comprises a hemp, e.g. made with two mutually plied threads, and still more preferably having a yarn number with value between 2/28,000 Nm and 2/40,000 Nm.

In the spirit of the present invention, regarding the materials eligible for the realization of the ornamental element, of course multiple choices outside of the exemplary one listed above are possible, provided they maintain optical and structural differentiation relative to the selected material of preference for the base structure of the manufactured article.

Preferably, from the structural viewpoint, the base structure may include a single thread or two, three or four threads substantially parallel to each other: in the event that more threads are used, one of these is always made of nylon and the remaining one, two or three threads (and/or ribbons) may conveniently be made of other material.

Focusing attention on knottings, it can be noted that these can be mutually spaced 1 to 5 millimetres apart on the base structure, and are preferably spaced 3 millimetres apart from one another.

The type of realizable knotting is conveniently variable depending on the embroidery machinery employed for producing the present manufactured article, and it may also be that, in the case of a base structure with two or more threads, knottings can be made to define the thread and/or ribbon sections alternately arranged in opposed half-spaces with respect of the imaginary lying plane of the threads and/or ribbons defining the base structure.

Alternately, in the case of a single-thread and/or ribbon base structure (for instance, where there is only the nylon thread), it can be noted that the ornamental thread and/or ribbon always substantially remains in a same half-space relative to the ideal lying plane of the threads and/or ribbons constituting the base structure.

The object of the present invention also includes a method for manufacturing an improved textile manufactured article on embroidery machinery (which will be adapted to perform macramé-type processing):

this method is thus specifically suitable to make an improved manufactured article according to the description so far (and as claimed below) and mainly comprises the following steps:

first, a provisional base structure is weaved, which can be arranged into warp and weft and/or according to a pre-determined ornamental pattern:

this provisional base structure comprises a pre-determined number of thread-like and/or ribbon-like elements, made at least of a first nylon material having a yarn number comprised between 40,000 Nn and 80,000 Nm (which thus constitute the "final" base structure of finished manufactured article 1 according to the invention) and at least one thread-like/ribbon-like element made of a material that can be discharged (for example, an acetate or, more generally, a textile material which, in the jargon of this technical field, is termed "chemicalized" material);

the above-mentioned provisional base structure is associated to at least one ornamental thread-like and/or ribbon-like element, which is conveniently made of at least one second material different from the material the base structure is made of (both the "provisional" and "final" one) in terms of mechanical resistance and or light reflection/refraction; and finally the thread-like and/or ribbon-like element made of material that can be discharged are destroyed (e.g. by chemical melting in solvent and/or by pyrolysis), so as to obtain a final base structure interconnected to the ornamental thread-like and/or ribbon-like element.

Conveniently, the association step of the ornamental thread-like and/or ribbon-like element to the provisional base structure comprises a sub-step of making a plurality of knottings arranged at pre-defined intervals along the provisional base structure itself: these knottings may be realized simultaneously to the provisional base structure definition/realization step.

The invention provides a number of advantages, in addition to those previously explained.

In fact, due to the unique structural architecture of the manufactured article, it is possible to obtain remarkable mechanical features without the necessity of a high mesh density: this makes it possible to realize very "open" structures, thus preserving the typical aesthetic appearance of embroidered manufactured articles, associating this aesthetic appearance to an ability to resist to traction/tear/cut which definitely cannot be found in traditional embroidered manufactured articles.

At the same time, the unique interconnection mode between the elements constituting the mesh structure of the present manufactured article makes it possible to obtain high coherence and maintenance of both mesh structure and aesthetic appearance, as well as a visual peculiarity (precisely obtained with the succession of knots nested between the support structure and the ornamental strand) which cannot be found in the state of the art.

Further, the particular choice of materials that can form the support structure gives the embroidered manufactured article particular optical properties, which, in turn, create a metallic/reflective/shiny finish, which is definitely unattainable in manufactured articles of the known type.

Departing from the viewpoints of the production methodology, the use of embroidery machinery offers an extremely broad freedom of choice of the mesh structures, advantageously associated to reduced set-up timing for the machines themselves: this allows satisfying highly variable requests in very short times, thus maximizing plant productivity and flexibility.

Finally, it is noteworthy that the present invention allows keeping low production prices of the manufactured article and does not involve particular complications and modifications or adaptations, also on known-type machinery, to the advantage of the overall production economy and of the final product price.

The invention claimed is:

1. Improved textile manufactured article realized by embroidery machines, comprising:

a base structure composed of thread-like and/or ribbon-like elements made at least of a first material, at least one thread-like and/or ribbon-like element made of at least a second material, different from said first material in terms of mechanical resistance and or light reflection/refraction; said ornamental thread-like and/or ribbon-like element being connected to said base structure through a plurality of knottings disposed at pre-defined intervals along said thread-like and/or ribbon-like elements made of at least one first material, characterized in that said first material is a nylon having a yarn number between 40,000 Nm and 80,000 Nm.

2. Manufactured article according to claim 1, wherein said nylon has a yarn number between 40,000 Nm and 60,000 Nm.

3. Manufactured article according to claim 1, wherein said second material comprises a cotton.

4. Manufactured article according to claim 3, wherein said cotton is made of two mutually plied threads and defines an overall diameter comprised between 20 μm and 80 μm.

5. Manufactured article according to claim 4, wherein said cotton defines an overall diameter equal to 60 μm.

6. Manufactured article according to claim 1, wherein said second material comprises a silk.

7. Manufactured article according to claim 6, wherein said silk is made of two mutually plied threads.

8. Manufactured article according to claim 7, wherein said silk defines a yarn number of 2/120,000 Nm.

9. Manufactured article according to claim 1, wherein said second material comprises a lamé and/or a Lurex.

10. Manufactured article according to claim 9, wherein said lamé and/or Lurex is and/or are twisted with at least a polyamide thread.

11. Manufactured article according to claim 10, wherein said lamé and/or Lurex has and/or have a weight percentage of polyamide between 10% and 28% and of viscose between 90% and 72%.

12. Manufactured article according to claim 1, wherein said second material comprises a polyester.

13. Manufactured article according to claim 1, wherein said second material comprises a cashmere.

14. Manufactured article according to claim 13, wherein said cashmere is single-threaded and has a yarn number of 280 deniers.

15. Manufactured article according to claim 1, wherein said second material comprises a viscose.

16. Manufactured article according to claim 3, wherein said viscose has a yarn number greater than or equal to 80,000 Nm.

17. Manufactured article according to claim 1, wherein said second material comprises a linen.

18. Manufactured article according to claim 3, wherein said linen has a yarn number comprised between 15,000 Nm and 16,000 Nm.

19. Manufactured article according to claim 17, wherein said second material comprises a linen, having an amount by weight of 90%, and a silk, having an amount by weight of 10%.

20. Manufactured article according to claim 19, wherein said second material has a yarn number of 39,000 Nm.

21. Manufactured article according to claim 1, in which said second material comprises a linen, having an amount by weight of 70%, and a Tencel®, having an amount by weight equal to 30%.

22. Manufactured article according to claim 21, wherein said second material has a yarn number of 26,000 Nm.

23. Manufactured article according to claim 1, wherein said second material comprises a hemp.

24. Manufactured article according to claim 23, wherein said hemp is single-threaded, and has a yarn number of 36,000 Nm.

25. Manufactured article according to claim 1, wherein said hemp is made of two mutually plied threads.

26. Manufactured article according to claim 25, wherein said hemp has a yarn number with value between 2/28,000 Nm and 2/40,000 Nm.

27. Manufactured article according to claim 1, wherein said base structure is organized in mutually interconnected weft threads and warp threads.

28. Manufactured article according to claim 1, wherein the base structure defines an embroidered ornamental pattern, said ornamental pattern being made with an embroidery machine, adapted to perform macramé-type processing.

29. Manufactured article according to claim 1, wherein said knottings are mutually spaced 1 to 5 millimetres apart on the base structure.

30. Manufactured article according to claim 3, wherein said knottings are spaced 3 millimetres apart from one another.

31. Manufactured article according to claim 1, wherein the base structure comprises a single thread or two, three or four threads substantially parallel to each other, said two, three or four threads being constituted by one nylon thread and by one, two or three threads of other material.

32. Method for manufacturing an improved textile manufactured article on embroidery machinery, said embroidery machinery being adapted to perform macramé-type processing, said method being adapted to make a manufactured article according to claim 1 and comprising the following steps:

weaving a provisional base structure, which can be arranged into warp and weft and/or according to a pre-determined ornamental pattern, said provisional base structure comprising a pre-determined number of thread-like and/or ribbon-like elements, made at least of a first nylon material having a yarn number comprised between 40,000 Nm and 80,000 Nm and at least a thread-like/ribbon-like element made of a material that can be discharged;

associating to said provisional base structure at least one thread-like and/or ribbon-like element made of at least a second material different from said first material in terms of mechanical resistance and/or light reflection/refraction, said ornamental thread-like and/or ribbon-like element being connected to said provisional base structure comprising a sub-step of making a plurality of knottings arranged at pre-defined intervals along the provisional base structure itself; and destroying said thread-like and/or ribbon-like element made of material that can be discharged so as to obtain a final base structure interconnected to the ornamental thread-like and/or ribbon-like element.

33. Method according to claim 32, wherein said material that can be discharged is acetate.

34. Method according to claim 32, wherein said destroying of said thread-like and/or ribbon-like element made of material that can be discharged is made by chemical melting in a solvent and/or by pyrolysis.

* * * * *